US006553716B2

(12) United States Patent
Bruns

(10) Patent No.: US 6,553,716 B2
(45) Date of Patent: Apr. 29, 2003

(54) SAFETY CATCH ASSEMBLY FOR DOORS; DOOR ASSEMBLY; AND, USE

(75) Inventor: James A. Bruns, Grand Rapids, MN (US)

(73) Assignee: Broncho Company, Hibbing, MN (US)

( * ) Notice: Subject to any disclaimer, the term of this patent is extended or adjusted under 35 U.S.C. 154(b) by 0 days.

(21) Appl. No.: 09/942,466

(22) Filed: Aug. 29, 2001

(65) Prior Publication Data

US 2003/0051409 A1 Mar. 20, 2003

(51) Int. Cl.[7] ..... E05D 13/00
(52) U.S. Cl. ..... 49/322
(58) Field of Search ..... 49/322, 449, 451, 49/506

(56) References Cited

U.S. PATENT DOCUMENTS

| | | | | |
|---|---|---|---|---|
| 1,159,563 A | | 11/1915 | Baldwin et al. | |
| 1,314,572 A | | 9/1919 | Coleman et al. | |
| 1,998,233 A | | 4/1935 | Greegor | |
| 2,095,695 A | | 10/1937 | Greegor | |
| 2,411,713 A | * | 11/1946 | Denison | 49/322 |
| 2,651,817 A | | 9/1953 | Moler | |
| 2,869,183 A | | 1/1959 | Smith | |
| 3,188,698 A | | 6/1965 | Zoll et al. | |
| 4,368,700 A | * | 1/1983 | Ulfhielm | 49/322 |
| 4,914,862 A | * | 4/1990 | Gregory | 49/322 |

FOREIGN PATENT DOCUMENTS

| | | | | |
|---|---|---|---|---|
| FR | 702462 | * | 4/1931 | 49/322 |
| RU | 563472 | * | 1/1973 | 49/322 |

OTHER PUBLICATIONS

Exhibit A1 Drawing of a safety catch assembly having a control arm pivotally connected to side plates, 1 page (Jul. 29, 1994).

Exhibit A2 Drawing of a safety catch assembly of Exhibit 1A installed on a garage door, 1 page (Date Unknown of drawing).

* cited by examiner

*Primary Examiner*—Jerry Redman
(74) *Attorney, Agent, or Firm*—Merchant & Gould P.C.

(57) ABSTRACT

A safety catch assembly is described in the environment of use of a vertical lift door panel. The preferred safety catch assembly in general includes: first and second brake members; an actuator assembly including a stay mechanism and a release mechanism; and, a biasing mechanism constructed and arranged to move the first and second brake members into braking positions, in response to a defined, selected, catastrophic failure. In general, the stay mechanism operates to maintain the first and second brake members in free or non-brake positions until the defined catastrophic failure occurs; and, the release mechanism operates to release the first and second brake members for movement into the braking positions, upon the defined catastrophic failure of the lift mechanism.

24 Claims, 10 Drawing Sheets

SAFETY CATCH ASSEMBLY FOR DOORS; DOOR ASSEMBLY; AND, USE

FIELD OF THE INVENTION

The present invention relates to doors. The invention particularly concerns safety catch arrangements, for vertically lifted doors, which operate to brake downward movement of a door panel, should a control cable loosen, break or should a similar catastrophic release occur.

BACKGROUND OF THE INVENTION

In a variety of industries, building constructions with large doorways are used. The present disclosure concerns doorway openings in such constructions. As an example, a typical doorway opening in a building at a mining site will be characterized as background.

At a mining site, a doorway in a service building or other facility would need to be adequately large to handle very large mining equipment being moved into and out of the building. A typical such doorway would be, for example, 30–40 feet wide by 30–40 feet tall.

In general, such doorways are closed by door panels that are lifted upwardly (vertically) to selectively open the doorway. Typically such door panels are cable operated.

In typical large doors of the type characterized above, the movable door would generally comprise at least one and typically two or more panels, each panel being about 30–40 feet wide, by about 10–15 feet high. Each panel would typically weigh at least 100 lbs, often on the order of 1,000–3,000 lbs., and sometimes more, typically being constructed from structural steel framework elements covered by steel sheeting, for example 14 gauge steel sheeting. In some instances, the panels would be constructed in segments, secured together at the building construction site.

In order to accommodate an opening of 30–40 feet tall, typically the door would comprise 2–4 vertically movable segments, each of which extends completely, horizontally, across the doorway. For such arrangements, the panels would be positioned vertically offset from one another, when the door is closed.

Typically the panels are moved by a cable system using a counterweight system, so that all panels are moved at the same time, back-and-forth between lower (closed) and upper (open) positions. When in the upper position, the panels are typically aligned juxtaposed to one another, each maintained in a vertical orientation. In order to be aligned juxtaposed in the upper position, but positioned with one panel above the other when in a closed or lowered position, it is generally required that each panel be offset from the next adjacent panel. Thus, when the door is in the lowered position, although each panel (except for the bottom panel) is above a next lower panel, it is not directly above that panel, but rather it is above and either slightly behind or slightly in front of the next lower panel.

In general, it is desired to have safety catch systems to control downward movement of the panels, should a catastrophic failure in the system occur. The current disclosure concerns an advantageous safety catch arrangement, for such doors.

SUMMARY OF THE INVENTION

A safety catch assembly for selectively inhibiting downward movement of a door panel is provided. The preferred safety catch assembly in general comprises at least one, and typically first and second brake members positioned, when installed, to selectively move from a free position to a braking position. When in the braking position, each brake member engages a side portion of a rail. When two brake members are used, they are preferably positioned with braking forces generally in opposite directions, to brake the door panel. That is, in general, when two brake members are used, they are positioned to either: (a) apply the braking forces directed toward one another, i.e., with the braking force of one directed against the braking force of another; or, (b) to apply the braking forces with the braking force of one being applied in a direction approximately 180° from the direction of the braking force of the other. The particular arrangement chosen, with respect to this, generally depends upon the nature of the rail.

Herein, when it is said that each brake member engages in a "rail" reference is meant to a rail system on which the door panel is mounted, for vertical movement. When it said that a brake member engages a "side" or "side portion" of that rail, reference is meant to a side or side portion of the rail which extends generally parallel to a side of the door panel, as opposed to an edge or other surface of the rail which generally is directed toward an end of the door panel. Two particular arrangements of rails are described and shown in the figures below.

Herein, when reference is meant to a structure and its operation "when installed" it is meant when the safety catch assembly is operably assembled and installed in a door system, for operation. That is, the safety catch assembly is a component assembly mountable in or on a door panel in association with a vertical rail, for operation. Thus, when the equipment is characterized in terms of "when installed" it is meant when operably installed for proper function.

In general, the safety catch assembly includes an actuator assembly having a stay mechanism and a release mechanism: the stay mechanism maintaining the brake member(s) in the free or unlocked orientation or position (when installed) until failure of a lift mechanism for the panel; and, the release mechanism being constructed and arranged (when installed) to release the brake member(s) for movement into the braking orientation(s) or position(s), upon a selected or defined catastrophic failure of the lift mechanism.

The safety catch assembly also includes a biasing mechanism that biases the brake member(s) into the braking position(s), when the release mechanism is actuated to release the brake member(s) for movement into the braking position(s).

The assembly may, in some instances, be operated with a single rail side engaging brake member. However, in general two brake members will be preferred. In preferred constructions, the brake members are rotatable, between the free and braking orientations.

The present invention not only relates to preferred safety catch arrangements, but also to vertical lift door assemblies that include the safety catch assembly operably installed thereon; and, also, to methods of installation, assembly and braking.

BRIEF DESCRIPTION OF THE DRAWINGS

FIG. 1 being of the door assembly in a closed or lowered orientation.

FIG. 3 being generally taken along line 3—3, FIG. 1.

FIG. 7 being schematic and with selected portions out of view being shown in phantom.

DETAILED DESCRIPTION

In the present description, safety catch assemblies are described in the environment of use operably installed in a two-panel vertical lift cable assisted door. It is noted that the arrangements can be utilized in association with doors having more or fewer panels, lifted by a variety of mechanisms.

I. General Characterizations of the Safety Catch Assembly

In general, safety catch assemblies, according to the present disclosure, are constructed as arrangements selectively inhibiting uncontrolled downward movement of a door panel, for vertically lifted door assemblies. In general, the door assemblies are of the type which include at least one panel that travels vertically, in a track defined between first and second, stationary, vertical side rails, upon operation of a door panel lift mechanism. The safety catch assembly operates to inhibit the downward movement of one or more selected door panel during defined types of catastrophic failures in the door panel lift assembly or mechanism. Examples of such catastrophic failures, would be cable loosening or break, in a cable lift mechanism which utilizes a cable to raise and lower the selected door panel.

In general, the preferred safety catch assembly includes:

1. First and second rail side engaging brake members that, when installed, can be moved into braking positions to engage side portions of a side rail along which the panel is moved preferably by braking forces applied in opposite directions;
2. An actuator assembly including a stay mechanism and a release mechanism:
   (a) the stay mechanism operating, when installed, to maintain the first and second rail side engaging brake members in free, unlocked or non-brake positions until the defined or selected catastrophic failure of the lift mechanism; and
   (b) the release mechanism, when installed, being constructed and arranged to release the first and second brake members for movement into the braking positions, upon the selected catastrophic failure of the lift mechanism; and
3. A biasing mechanism, which, when installed, is constructed and arranged to bias the first and second brake members into the braking positions, when the release mechanism is actuated to release the brake members.

It is noted that in some instances it may be possible to utilize only a single brake member, which engages a side of a side rail, as opposed to two brake members. However, in general, preferred constructions will provide movement of two brake members as described above, for reasons which will be apparent from the following descriptions.

Hereinbelow, and in the figures, examples of useable arrangements for these components are provided.

II. A Typical Vertical Lift Door Assembly

Figure 1:
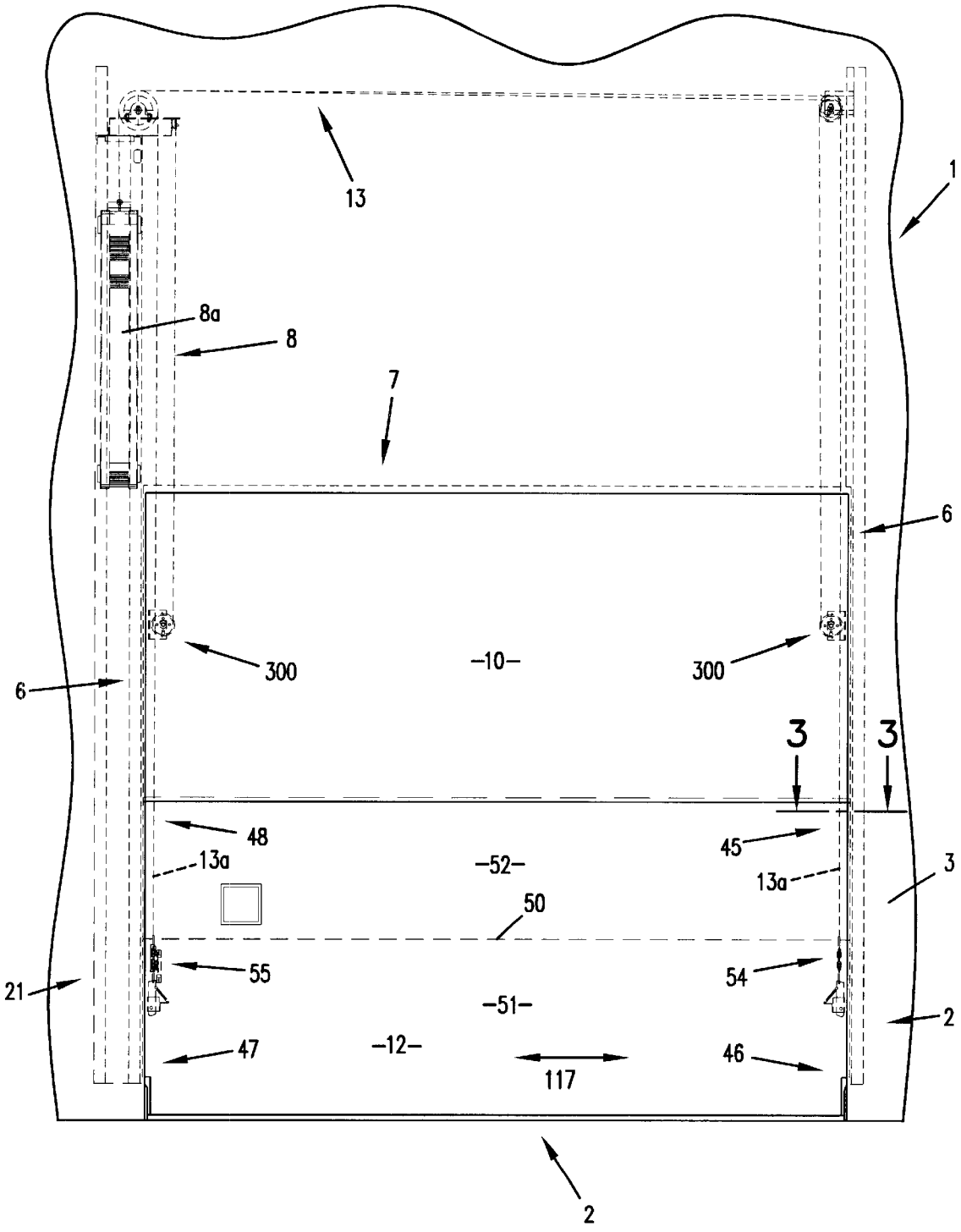
FIG. 1 is a schematic elevational view of a building having a door assembly with a safety catch assembly installed thereon, according to a first embodiment of the present invention.

In FIG. 1, a schematic representation is presented of a typical two-panel vertical lift door assembly. Referring to FIG. 1, the door assembly is generally indicated at reference No. 1. The assembly 1 is mounted in a doorway 2 of a building construction 3. Other than the safety catch assembly described below, the assembly 1 generally comprises the following principal components: door frame track assembly 6; door panel arrangement 7; and, door lift mechanism 8.

Figure 2:
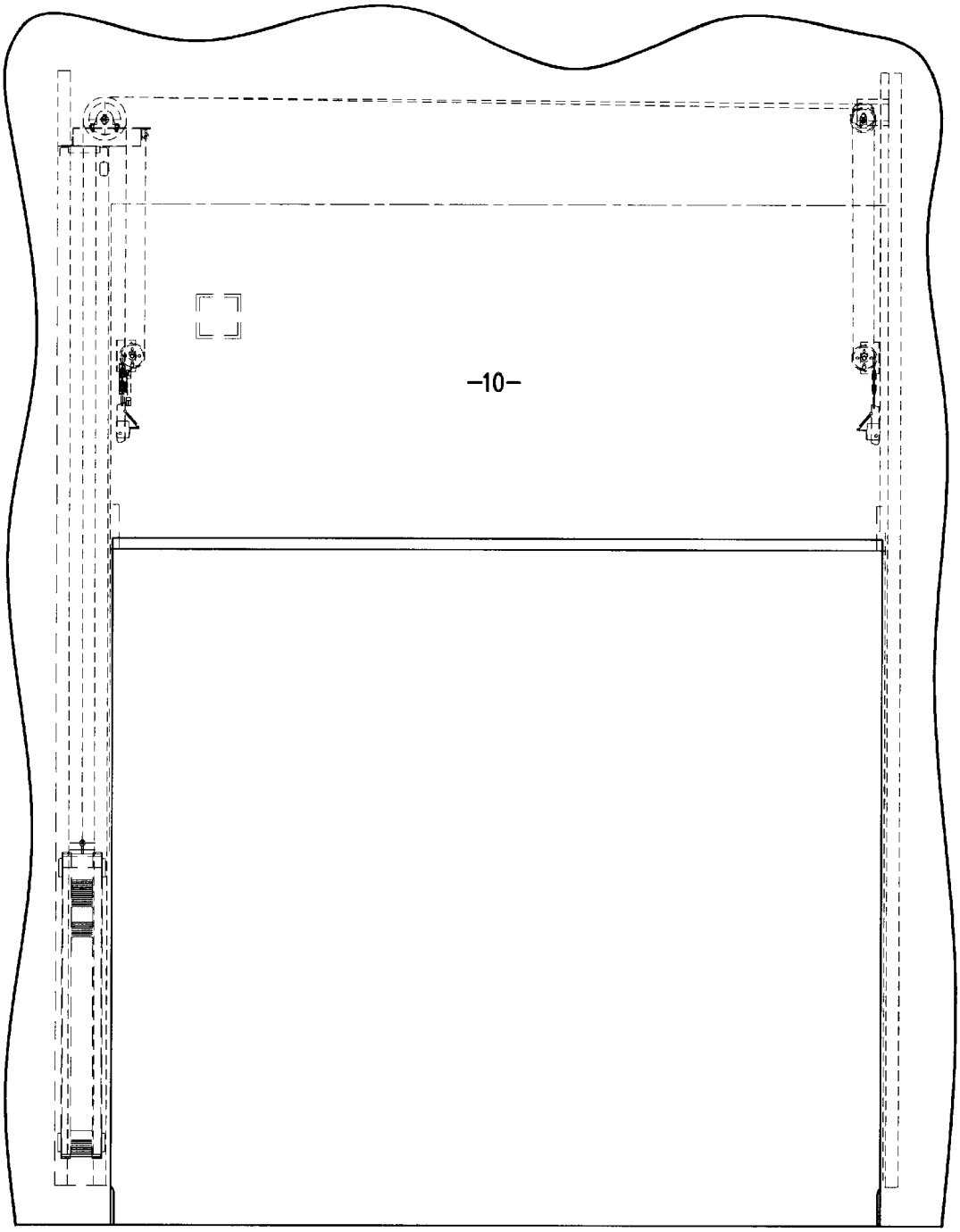
FIG. 2 is a schematic elevational view analogous to FIG. 1, but depicting the door assembly in an open or upper orientation.

For the particular assembly 1 depicted in FIG. 1, the door panel arrangement 7 comprises two panels or panel sections, 10 and 12, each typically having a weight of at least 100 lbs, typically at least 500 lbs, often at least 1,000 lbs and indeed panels of 1,000–3,000 lbs. or more are common. Each panel is vertically movable on door frame track assembly 6, under control of the lift mechanism 8, between a lowered or closed position as depicted in FIG. 1, and a raised or upper position, FIG. 2. In general, movement of each of the panels 10 and 12 between the lower position and the upper position is by vertical movement only, with no tipping, rolling or bending from a vertical position.

The view of FIG. 1 is of an exterior to the building 3, facing the assembly 1. Although the panels 10 and 12 can be oriented in a variety of manners, for the particular arrangement depicted, panel 10, the uppermost panel, is closest to the viewer, with panel 12 below, and slightly offset behind, panel 10. Thus, when the panels 10 and 12 are moved vertically to the uppermost position, FIG. 2, panel 12 will slide into a position immediately behind panel 10. To accommodate this motion, the panels 10 and 12 ride up and down on tracks. In particular, panel 12 slides up and down its own track, which track is offset from (behind) the track on which panel 10 moves.

In many conventional assemblies such as assembly 1, both panels 10 and 12 are controlled by the same counterweight lift mechanism 8. That is, a single counterweight 8*a* would be moved up and down, to cause motion upwardly and downwardly of both panels 10 and 12 simultaneously. However, in other conventional systems two or more counterweight towers may be used. The principles described herein would apply to either. The controlling link between the counterweight 8*a,* and the panels 10, 12, is typically a cable system 13. In general, the cable system 13 operates with cables managed through various links, to cause a different rate of movement of the two panels 10 and 12, given a defined movement of the counterweight 8*a*. For example, typically a control cable system 13*a* running from the counterweight 8*a* to the bottom most panel 12 would go over an overhead pulley system, so that a movement downward of the counterweight 8*a* by one foot would lift the bottom most panel 12 by one foot. However, in order to manage the panel movements such that both panels 10 and 12 reach the uppermost position, FIG. 2, or the downward most position, FIG. 1, at the same time, and upon the same vertical movement of the counterweight 8*a,* it is preferred that the cables be strung such that movement of the downward most panel 12 has approximately two times the vertical movement of the uppermost panel 10, with the same linear movement of the counterweight 8*a*. This is managed by utilizing appropriate cable/pulley arrangements, in a conventional manner.

It is noted that for a typical assembly 1, each panel (10, 12) is moved by two cable extensions, one associated with each end (side) of the panel. This allows for an even pull on each end of each panel, facilitating vertical movement without jamming in the tracks. In some systems a third cable is provided attached to the middle of the panel, to facilitate movement.

It is noted that the arrangement could be made with more panels, for example, three or more panels, as suggested above. When such is the case, the cables of the lift mechanism are typically managed in a conventional manner to ensure that all panels reach their uppermost and lowermost positions at the same time. In general, the principles would be analogous to those characterized above for a two panel construction.

It is also noted that in some systems, separate cable and counterweight systems are used for each panel, rather than interconnected ones. The principles disclosed herein are also applicable to such systems.

As thus far characterized, the door panel assembly is conventional.

A. Construction and motion of panel 12.

In the current description, a detailed presentation is made relating to the construction and controlled motion of panel 12. This information will serve as a basis for generally understanding the motion of the other panel 10. Differences relating to the control of panel 10, of significance with respect to safety catch assemblies according to the present invention, will be provided below. However, except for such differences, the detailed disclosure with respect to the mounting and motion of panel 12 serves as a general basis for understanding mounting and motion of panel 10. Again, it is noted that with respect to mounting and motion, the panels 10 and 12 are conventional.

Still referring to FIG. 1, to simplify this description it will be assumed that, as is typical for conventional systems, panel 12 has a vertical plane of symmetry, with respect to its mounting and control mechanisms, although such is not required in all applications of the principles described herein. Based on this assumption, for the preferred embodiment depicted, the mounting and track mechanisms along side 20 are the same as along side 21, but oppositely mounted, i.e. mounted as a mirror image. Herein a detailed examination will be made of mounting and control mechanisms mounted along side 20, and the reader will understand that analogous mechanisms along side 21 can be used, mounted in a mirror image or opposite manner.

In general, door panel 12 travels vertically in movement back and forth between its upper and lower positions, between and upon vertical side rails of the door frame track assembly 6, one side rail being positioned adjacent each side 20, 21 of the panel 12. In general, each side rail on which panel 12 is mounted extends from at or near the floor or ground, i.e. the point of lowest travel of the panel 12, upward at least to the point of uppermost motion of the panel 12. (It is noted that for upper panel 10, the side rails would typically not extend to the floor, but only to the region of lower most travel of the panel 10.)

Figure 3:
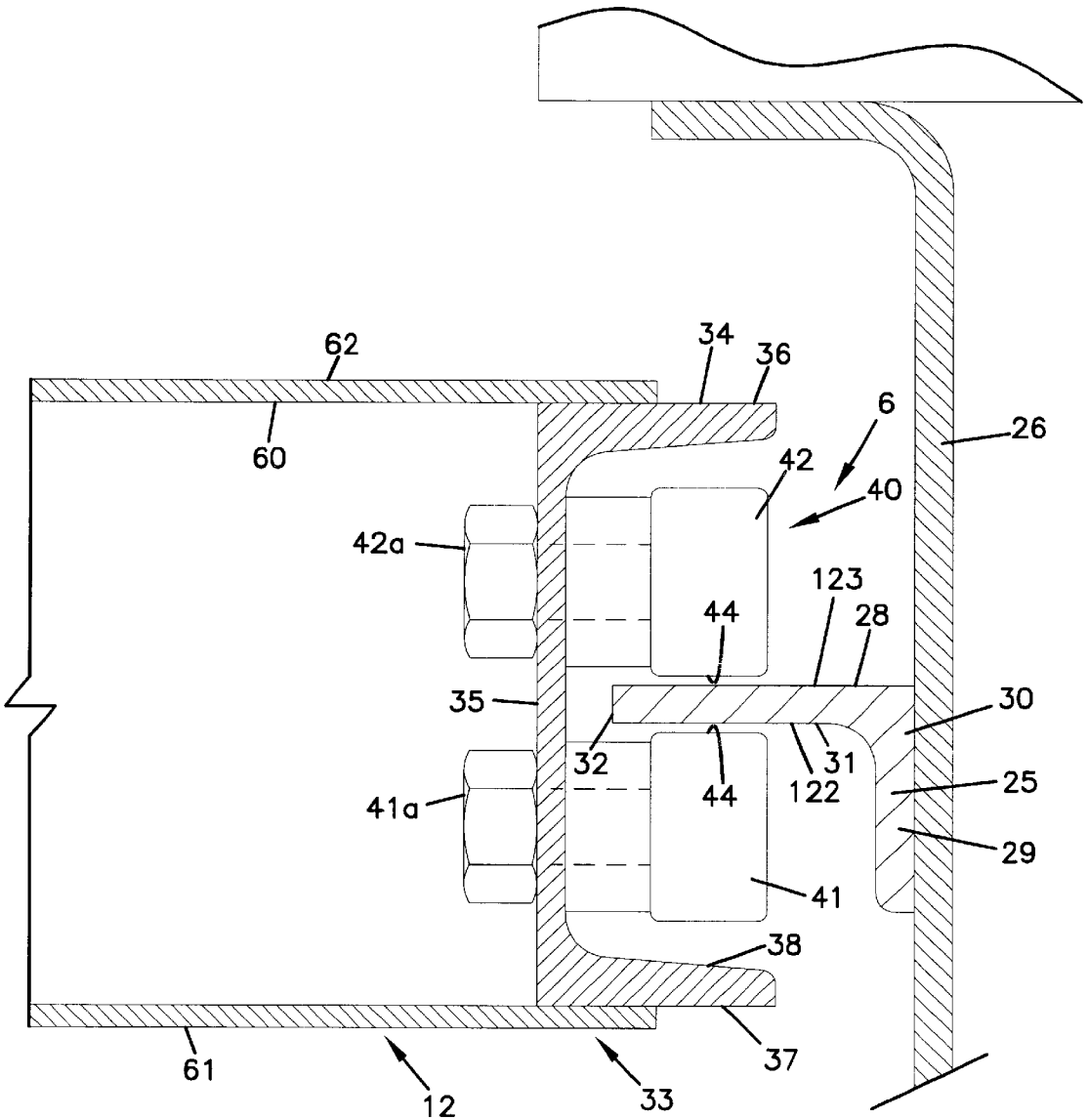
FIG. 3 is an enlarged schematic cross-sectional view of a portion of the assembly depicted in FIG. 1.
Figure 9:
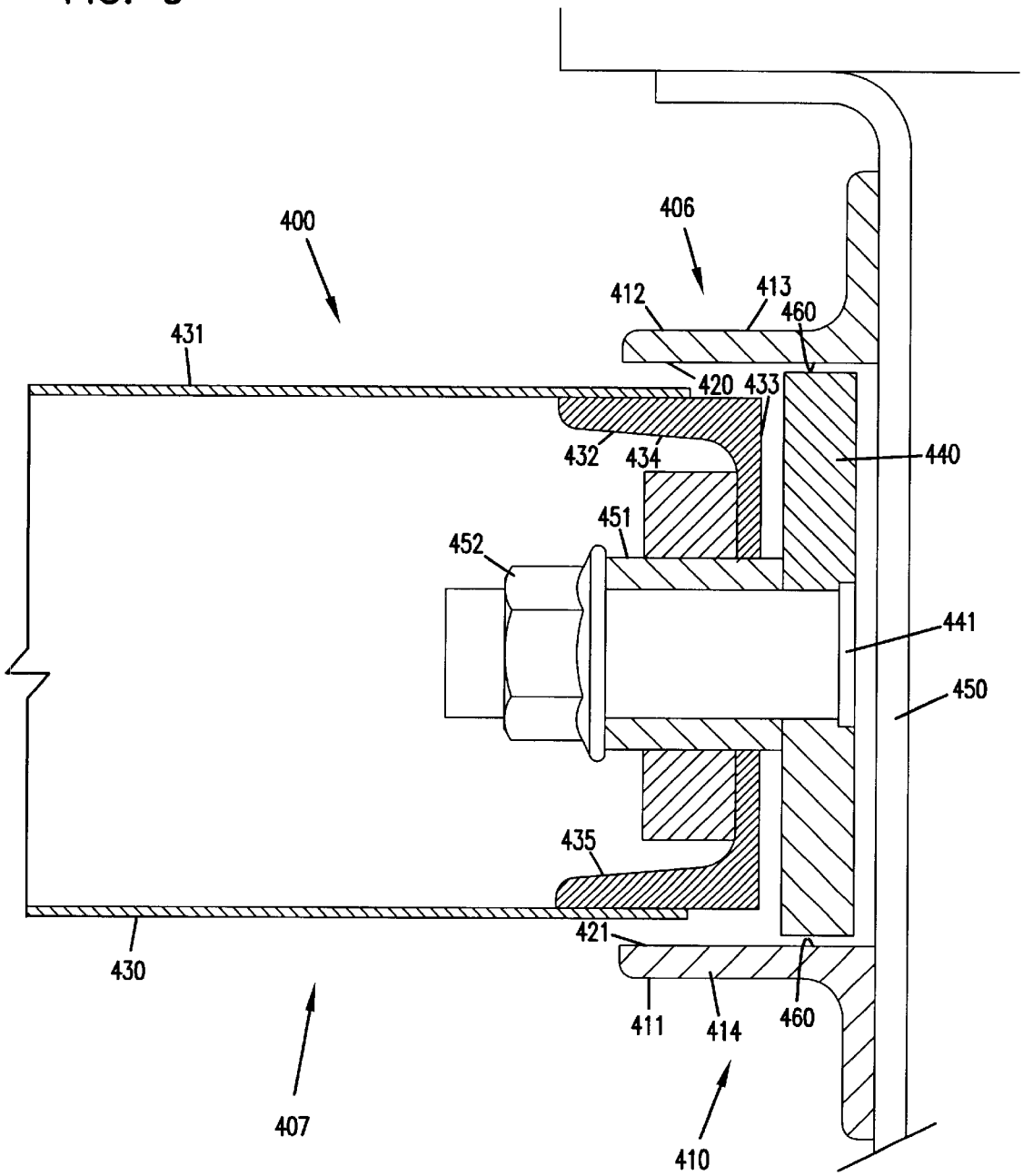
FIG. 9 is an enlarged schematic cross-sectional view analogous to FIG. 3, but depicting a mounting system for use with a second embodiment.

One common useable configuration for a typical interaction between a panel 12 and a vertical side rail arrangement is described herein, and is depicted in FIG. 3. An alternate rail and mounting configuration is depicted in FIG. 9 discussed in detail below.

Attention is now directed to FIG. 3. In FIG. 3, a typical useable mechanism for mounting and sliding of panel 12 on the doorframe track assembly 6 is shown in detail. In FIG. 3, a schematic fragmentary view is depicted of a portion of the arrangement 1 of FIG. 1.

Referring to FIG. 3, in general, the doorframe track assembly 6 comprises a track guide angle 25 secured to wall frame 26, typically by bolts not shown. Guide angle 25 generally comprises first and second legs 28 and 29, joined at corner 30. The guide angle 25, for bottom panel 12 extends from at or near the ground, to the uppermost point of vertical movement for the panel 12. For a vertical lift door of the type characterized herein, a typical guide angle 25 will comprise a rolled or bent steel angle having a thickness of about ¼ inch up to about ½ inch, with legs 28, 29 at least about two inches deep, i.e. each two inches in the direction of the cross-section, FIG. 3. For the particular assembly 6 shown, leg 28 comprises a vertical side rail 31 (having edge 32 directed toward panel 12) for movement of panel 12, as follows.

Still referring to FIG. 3, panel 12 has, mounted on end 33 adjacent guide angle 25, an end member 34, having base 35 and opposite sides 36, 37, defining central trough 38. In general, end member 34 extends completely along end or side edge 33 of panel 12, closing same and providing a mount for various mechanisms as described. At locations as defined below, end member 34 may include various features such as openings therein, to accommodate mechanisms described in greater detail below. In portions, wall 35 may be reinforced by plates, not shown.

Referring to FIG. 3, mounted on end member 34 is a pair 40 of guide rollers 41, 42. The guide rollers 41, 42 are mounted, by bolts 41*a,* 42*a,* on end member 34 spaced apart, on opposite sides of leg 28. The guide rollers 41, 42 generally retain the panel 12 on the track or side rail 31 represented by leg 28, during vertical movement of bottom panel 12. Thus, in general terms, the guide rollers 41, 42 are spaced apart to define a rail track or path 44 therebetween. When the arrangement is assembled and installed, the rollers 41, 42 are positioned on opposite sides of the rail 31 to retain the panel 12 oriented adjacent leg 28 (with edge 32 directed toward base 35) as it is lifted and lowered between various positions during operation of the door. In general, rollers 41, 42 are oriented sufficiently spaced to allow for an additional 0.25 to 0.5 inch spacing over the thickness of rail 31.

A typical bottom panel 12 would have at least four sets of such guide rollers mounted thereon, two along each end (side) edge, with one adjacent each corner, indicated generally in the corners identified by reference nos. 45, 46, 47 and 48, FIG. 1. Each set of rollers could generally be analogous to pair 40, FIG. 2.

In some instances, the panel 12 may be a spliced panel. In FIG. 1, a possible splice line is indicated in phantom at 50. When panel 12 is a spliced panel, typically it would comprise two sections or segments, as indicated at 51 and 52, FIG. 1, spliced together along the splice line 50. When such spliced panels are used, not only are rollers positioned in the four corners 45, 46, 47 and 48 where indicated, but typically a pair of rollers is also mounted on each end (or side edge) to bridge the splice 50, generally where indicated at 54, 55. A typical reason for use of spliced panels is when a single panel needs to be of a larger size than is readily transportable, and thus the panel 12 would be constructed in segments which are shipped and are then secured together (assembled) on site.

A variety of constructions can be used for rollers 41, 42 of the various roller pairs 40. Typical cam rollers of the type available from: McGill Manufacturing of Emerson Power Transmission Corp., Valparaiso, Ind., 46383; Carter-Manufacturing Colo., Grand Haven, Mich., 49417; Torrington Colo., Torrington, Conn., 66790; Pacific Bearing, Rockford, Ill., 61125; and, Schrade Ball Bearing Products Co., Westmont, Ill., 60559. Such rollers are typically of about 1.25–2.5 inches in diameter, with a width (wheel circumferential surface width) of about 0.75 to 1.5 inches. Such cam rollers are conventional, in this application.

From the above, operation of the panel 12 in association with the track arrangement 6 will be understood. In general, at each side 20, 21, the panel 12 would be positioned to ride on the frame track arrangement 6, by guide rollers on rails like rail 31. The rails would be spaced, horizontally apart, a distance appropriate to prevent the panel 12 from becoming dismounted at either side, even with extreme horizontal movement of the panel 12 in one direction or the other.

B. A Safety Catch Assembly.

Figure 4:
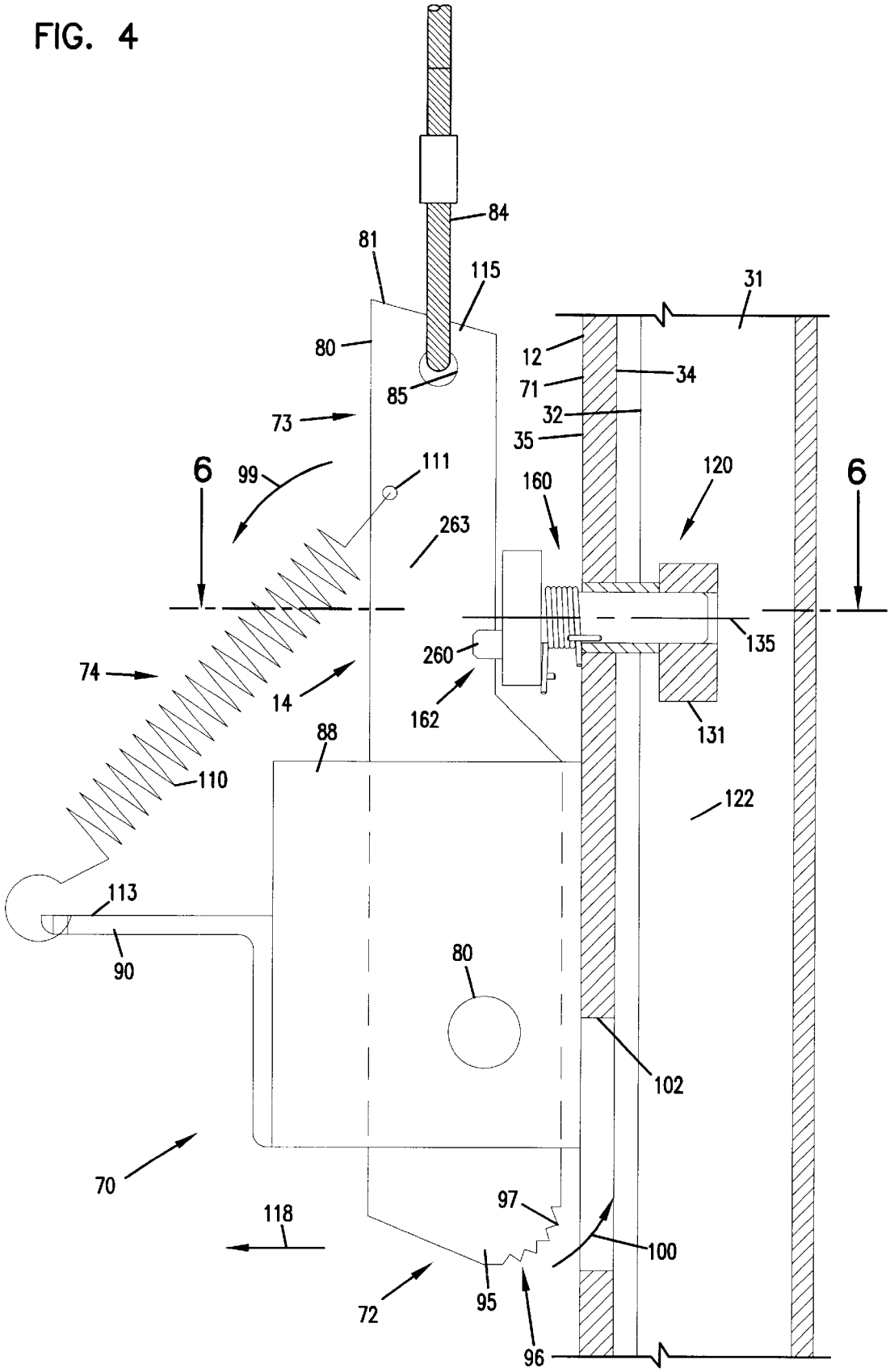
FIG. 4 is an enlarged fragmentary partially cross-sectional schematic view of a safety catch assembly portion of the arrangement depicted in FIG. 1, with the safety catch assembly oriented in a free or unlocked mode or position.

Attention is now directed to FIG. 4. FIG. 4 is a fragmentary schematic depiction of the safety catch arrangement or assembly according to the present invention. The particular embodiment of a safety catch assembly depicted in FIG. 4, comprises a modification made to a prior art safety catch assembly. Initially, portions of the FIG. 4 safety catch assembly which are from a prior art safety catch assembly, will be described in detail.

Figure 5:
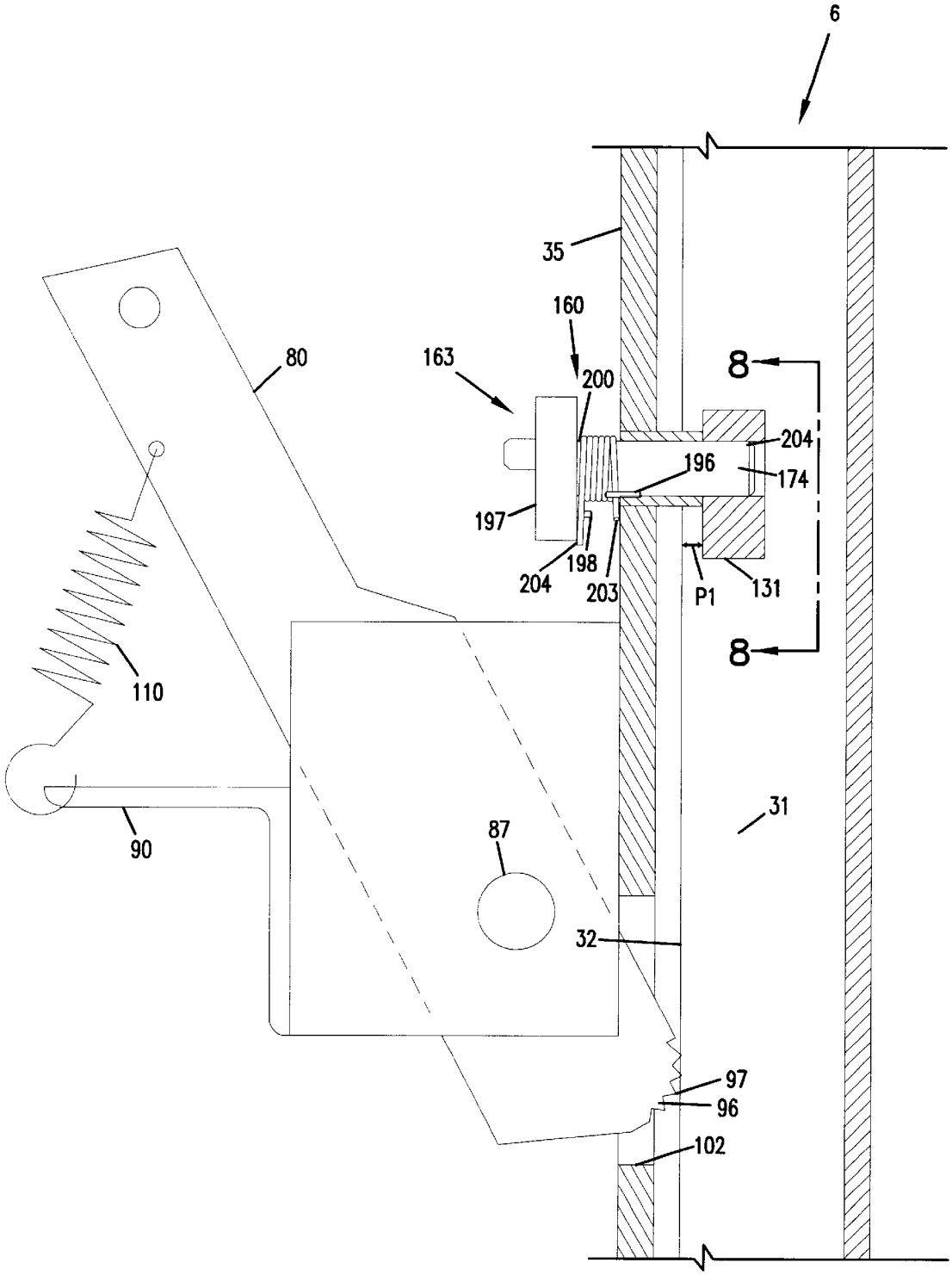
FIG. 5 is a view analogous to FIG. 4, but depicting the safety catch assembly in a locked or braking mode or position.

Referring to FIG. 4, the safety catch arrangement or assembly is generally depicted at 70. The safety catch assembly 70 is mounted (installed) on the door panel 12, generally in an interior 60 of the panel 12 between face panels 61, 62, FIG. 3. The portion 71 of the panel 12 depicted in the schematic view of FIG. 4, is the base 35 of end member 34. In general, the portions depicted of safety catch assembly 70 which were in a prior art safety catch assembly comprise: brake member 72, actuator mechanism or assembly 73; and, biasing mechanism or assembly 74. In operation, the prior art actuator assembly was secured in a release or free position, FIG. 4, during normal operation of the door panel 12. The arrangement was configured so that should a selected or defined type of catastrophic failure of a lift cable occur, the biasing mechanism 74 would bias the actuator mechanism 73 into a locking or biasing position, in which the brake member 72 would rotate into braking engagement with the edge 32 of rail 31, to cause braking. In FIG. 4, certain prior art componentry to provide this function, is shown. In FIG. 5, the braking orientation is shown.

Herein the term "release or free position" or variants thereof, is meant to refer to a position in which the safety catch assembly 70 is not operating to cause braking. This will also sometimes be referred to as an unlocked or set orientation or position. Alternatively, when the safety catch arrangement 70 is operated so that braking occurs, it will generally be referred to as being in a braking or locked orientation or position.

Referring to FIG. 4, the preferred actuator assembly 73 generally comprises a pivotally or rotatably mounted hanger arm, actuator arm or control arm 80. The preferred control arm 80 includes an upper end 81 secured to control or lift cable 84 at 85. The arm 80 is rotatably mounted about a rotation axis defined by axle 87, for pivoting or rotating between the positions of FIGS. 4 and 5. The position of FIG. 4 will sometimes be referred as the free, unlocked, non-braking or set position; and, the position of FIG. 5 will sometimes be referred as the locking, braking or failure position. In general, the pivotal mounting of the arm 80 for pivoting is accomplished by providing a hole in the arm 80, through which a fixed pin, rod or axle (not shown) extends. The axle would extend between spaced side plates 88, only one of which is viewable in FIG. 4.

The preferred actuator assembly 73 also includes anchor bracket 90 non-pivotally mounted on base 35. The fixed pin, on which arm 80 is mounted, would typically be supported in anchor bracket 90. Additional function of non-pivotable anchor bracket 90 will be apparent from further descriptions below.

The prior art rotatable brake member 72 preferably comprised lower end 95 of control arm 80, having a brake region 96. The preferred brake region depicted, comprises teeth 97.

In general, control arm 80 is mounted on axle 87 such that, during pivoting in the direction of arrow 99, brake member 72 rotates in the direction of arrow 100. Base 35 of end member 34 includes pivot aperture 102 therein, to accommodate (i.e. allow) movement of brake region 96 in the direction of arrow 100.

Still referring to FIG. 4, the preferred biasing mechanism 74 includes spring 110 mounted in tension between point 111 on an upper portion of control arm 80, above axle 87, and point 113, below point 111 and on non-pivotally mounted bracket 90. The spring 110, in general, is positioned in extension so that it will tend to bias control arm 80 out of the vertical (free or non-braking) position depicted in FIG. 4, and toward the locking, braking or failure position of FIG. 5 by rotation around axle 87, in the direction of arrow 99; i.e. away from wall 35. Alternatively, it could be said that the spring 110 is positioned to bias brake region 96, toward wall 35 in the direction indicated by arrow 100, FIG. 4, and into a braking orientation described below. Alternate biasing mechanisms can be used, with the control arm 80, as long as they are constructed to move the control arm 80 as desired, during operation. For example, a stretchable elastomer piece, of appropriate strength and memory, could be used, in the fashion of a heavy duty rubber band or cord.

As long as the cable lift mechanism is properly operating, the weight of the panel 12 will cause the control arm 80 to hang in the vertical position of FIG. 4, i.e. hanging downwardly from cable 84. This hanging weight generally keeps the brake member 72 from rotating into contact with any portion of rail 31, since the contraction strength of the spring 110 will generally be selected so its not to be able to overcome the vertical orientation maintained by the weight of the panel hanging from the cable 84. In this orientation of FIG. 4, the safety catch mechanism is in a free or non-braking orientation, allowing free or uninhibited movement of the panel 12 up and down along rail 31, as controlled by the lift mechanism 8, FIG. 4.

Should cable 84 break or loosen sufficiently, control arm 80 would be free to pivot around axle 87 to the failure position, FIG. 5, with pivoting caused by spring 110 contracting, since the weight of panel 12 would no longer operate with cable 84 to prevent such rotation. The pivotal movement would drive brake region 96, through pivot aperture 102 into engagement with edge 32 of rail 31, FIG.

5. (Thus it is an edge engaging brake). Frictional engagement between brake region 96, and edge 32, will generally cause the door panel 12 to bind in the doorframe track assembly 6, braking downward movement. Again, the braking position is shown in FIG. 5. For the particular arrangement depicted, in brake region 96 braking projections comprising teeth 97 are provided. In general, when brake region 96 is provided with projections such as teeth 97, it will be preferred that the projections or teeth 97 be constructed of a material which is in general harder than the material of the edge 32 of rail 31, so that in addition to frictional engagement, there will also be, under the pressure of the weight of the panel 12, a driving of the projections into the rail 31 somewhat, during braking.

Herein, a lift mechanism loosening or failure, which permits or initiates actuation of the brake mechanism, will generally be referred to as a selected or defined catastrophic failure. A typical such failure, for an arrangement such as that shown in FIG. 4, would be a cable break or substantial loosening. However, other failures, for example a failure of control arm 80 in region 115, FIG. 4, could similarly lead to actuation of the catch arrangement 70 into a braking orientation.

It is noted that typically the force of the braking applied by the brake region 96 against edge 32 need not by itself bear the entire weight of the panel 12. A reason for this is that pressure, under the downward force of the panel 12, will be directed into a horizontal mode which will tend to cause the panel 12 to fall unevenly on each side, and thus to jam in the frame track assembly 6.

C. Potential Issues With Prior Art Safety Catch Assemblies.

Although when properly aligned and positioned, safety catch assemblies of the type thus far described are effective, issues can arise. The issues generally arise with respect to one or more of the following:

First, referring to FIG. 1, door panels such as panel 12 are generally subject to movement, horizontally, in the directions of double-headed arrow 117. This movement, while relatively small, can, in some instances, be enough to move the safety catch arrangement far enough away from an associated guide angle, to-inhibit proper operation of the prior art safety catch assembly with the associated edge of the rail. In the context of the schematic shown in FIG. 4, if, as a result of the movement of the door panel 12 in the direction of arrow 118, FIG. 4, the panel 12 was moved away from edge 32 of rail 31, an adequate amount, the following problem could occur. Specifically, safety catch arrangement 70 could be moved adequately far away from edge 32 such that should cable 84 break, and arm 80 pivot, driving brake region 96 toward edge 32, the distance from edge 32 could be adequately far such that brake region 96 would not properly engage the edge 32, to cause a proper braking motion.

A second type of issue could result from improper installation or servicing, causing a failure of proper alignment between brake region 96 and edge 32. If misalignment should occur, the brake region 96 would not properly engage edge 32, to cause braking, should a catastrophic failure occur.

A third issue with prior art arrangements relates to a resetting of the safety catch arrangement, after a braking operation as a result of a catastrophic failure of the cable system, even when the safety catch arrangement operates properly. This results from the nature of the forces caused by the braking arrangement, when used. In particular, the downward force of a heavy door panel is significant. Under such downward pressure, during a catastrophic failure, the brake region 96 of a properly functioning safety catch arrangement 70 can cause significant lateral pressure on rail 31; i.e. force directed toward edge 32. With some constructions, this can bow the framework of the building construction 3, which can cause the panel arrangement 12 to improperly operate, once the safety catch has been released and the control arm 80 is reattached to a cable. Indeed, in some instances, the framework can be bowed enough to require replacement, for the total system to properly operate.

III. Improvements in Safety Catch Arrangement 70, From the Conventional Features Thus Far Characterized In this section, improvements in the safety catch arrangement 70, in addition to the prior art features already described, are presented and characterized in detail. The improvements help address the issues of the prior art system, characterized in the previous section.

A. The Rail Side Engaging Safety Catch Mechanism 120.

Referring to safety catch arrangement 70, FIG. 4, the portions of the safety catch arrangement 70, that are not prior art portions, are generally characterized herein as comprising a rail side engaging safety catch mechanism 120. This term refers to the fact that instead of mere engagement with edge 32 of rail 28, braking engagement for the rail side engaging safety arrangement 120, and thus safety catch 80, is with at least one side, and preferably two sides 122, 123 (FIG. 3) of leg, track or rail 31.

Herein, the term "side" when used in context with characterizing the rail, is meant to refer to a surface of the rail which, as distinguished from edge 32, extends generally parallel front and back panel surfaces of the door panel, as opposed as being directed toward the panel. In general, sides 122, 123 would be characterized as "opposed", since they are on opposite sides of rail 28.

Figure 6:
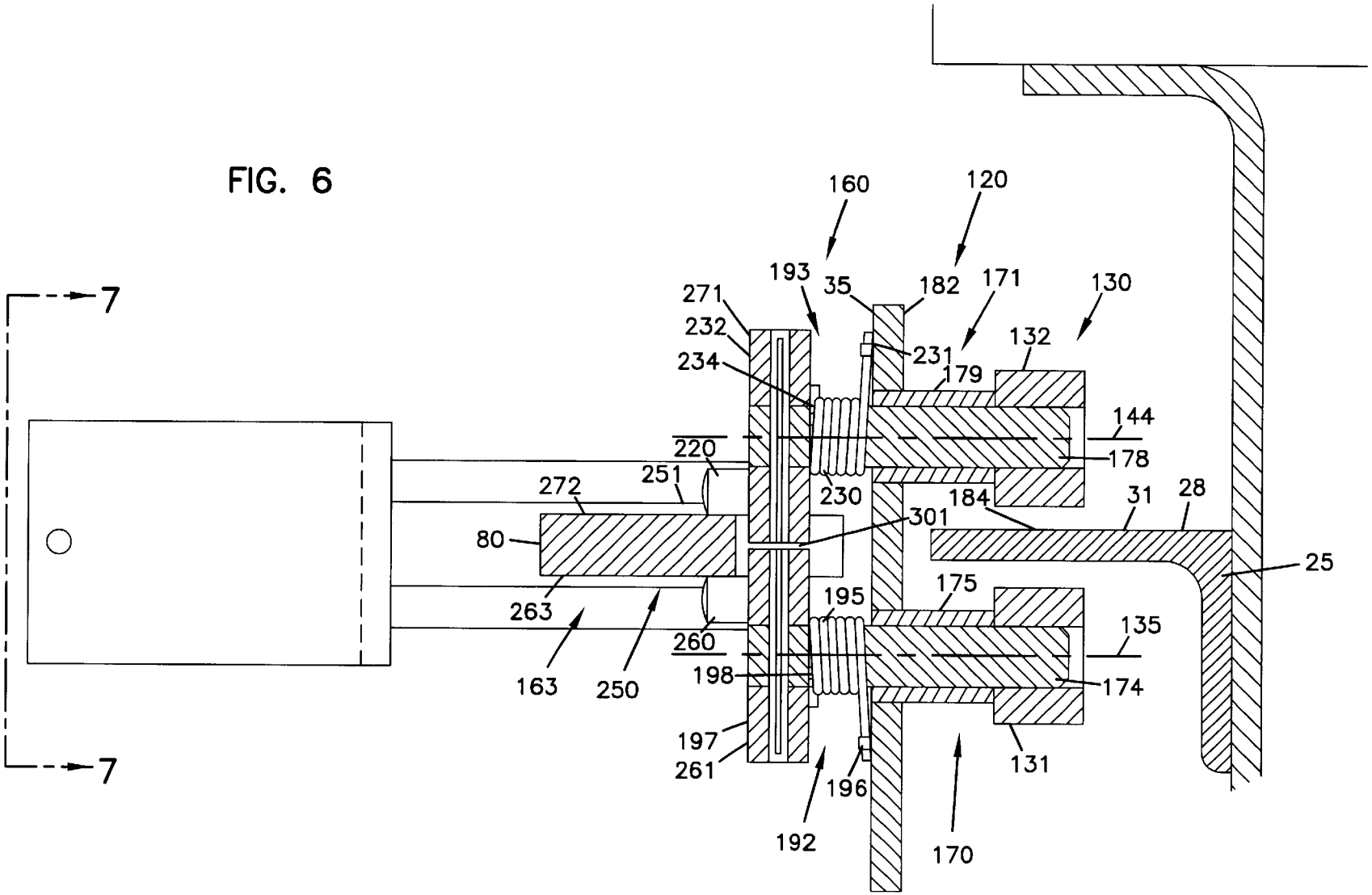
FIG. 6 is an enlarged cross-sectional view taken generally along line 6—6, FIG. 4.
Figure 7:
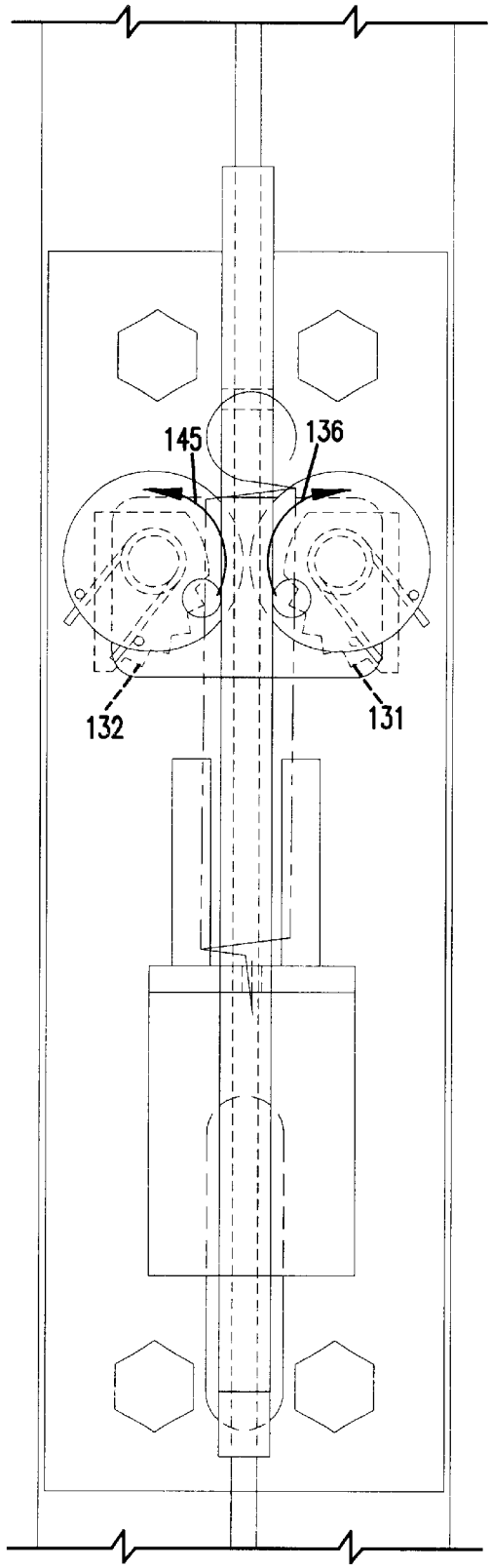
FIG. 7 is an enlarged schematic view taken generally from the viewpoint of line 7—7, FIG. 6.
Figure 8:
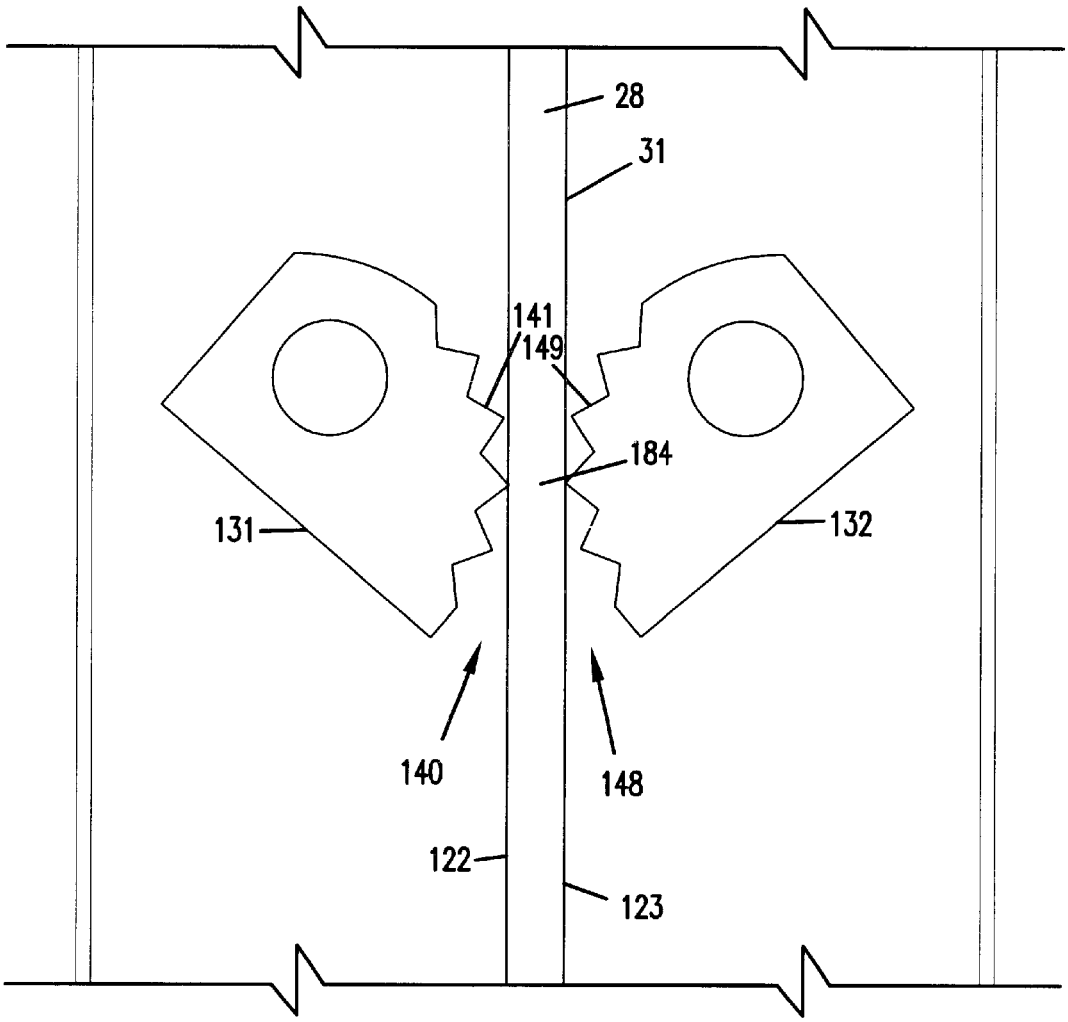
FIG. 8 is an enlarged fragmentary schematic view generally from the viewpoint of line 8—8, FIG. 5, and depicting each of two rotatable brake members of the safety catch assembly in locked or braking orientations or positions.

The operation of the braking system of a preferred rail side engaging safety catch mechanism 120 can be understood by reference to FIGS. 6–8. FIG. 6 is a cross-sectional view along line 6—6, FIG. 4. FIG. 7 is a fragmentary schematic side elevational view taken along the direction of lines 7—7, FIG. 6, with rail 31 of guide angle 25 depicted in phantom and showing a free or non-braking orientation. FIG. 8 depicts a braking orientation, viewed from the orientation of line 8—8, FIG. 5. Referring to FIG. 6, the preferred rail side engaging safety catch arrangement 120 includes jam assembly 130 preferably comprising first and second rail side engaging brake members 131, 132.

Referring to FIG. 6, brake members 131, 132 are depicted as they would appear in a free, unlocked or non-braking orientation, during normal operation of the assembly 1, i.e. with the lift mechanism 8 properly operating. Thus, brake members 131, 132 are not moved into braking contact with rail 31. In this regard, then, FIG. 6 is the same as FIG. 4.

Should a catastrophic failure in lift mechanism 8 occur, for example by a break or significant loosening in lift cable 84, FIG. 4, the rail side engaging safety catch arrangement 120 is actuated to move brake member 131 into contact with side portion or side 122 of rail 31; and because the preferred embodiment depicted includes two side engaging brake members 131, 132, brake member 132 will be actuated to move into braking contract with opposite (or opposed) side portion or side 123 of rail 31. The brake members 131, 132, can be biased into braking engagement with respective sides 122, 123 in a variety of manners. For the particular preferred arrangement depicted, brake members 131, 132 are rotatable brake members, that is they rotate between free and braking positions. As a result, the preferred rail side engaging safety catch arrangement 120 will be actuated to rotate brake member 131 about center axis 135 in the direction of arrow 136, FIG. 7, bringing brake region 140, FIG. 8, into braking engagement with side 122 of rail 31. Also, because the preferred embodiment depicted includes two rotatable brake members 131, 132, brake member 132 will also be actuated to rotate about axis 144 (FIG. 6) in the direction of arrow 145 (FIG. 7) to bring brake region 148 (FIG. 8) into braking engagement with side 123 of rail 31. Thus, the preferred brake members 131, 132 are actuated to apply braking forces in opposite directions, in this instance toward one another to pinch rail 31 (of guide angle 25) between them by applying forces from opposite directions to the sides of rail 31. Herein, when the brake members 131, 132 are moved into engagement with the rail 31, or guide angle 25, to apply forces in opposite directions on that rail or guide angle, and to inhibit downward motion of an associated corresponding door panel, the rail side engaging safety catch arrangement 120 will sometimes be referred to as being in the "braking" or "lock" position or orientation. Such an orientation is depicted in FIGS. 5 and 8.

From the above description, then, the term "rail side engaging" safety catch mechanism, will be understood to refer to a safety catch arrangement which engages one or more sides or side portions, as distinguished from an edge, of an associated rail. In this preferred instance, the rail side engaging safety catch mechanism 120 engages two opposite sides of a rail, with opposed forces.

It is noted that for the particular embodiment shown, the brake region 140 of brake member 131, the brake region 148, brake member 132, are each shown as regions having projections 141, 149, respectively. Alternate arrangements could involve alternate types of irregularities or projections provided in the surface areas depicted, or even use of abrasives or other materials applied to the appropriate surfaces to cause projections (or roughness). In general, it is preferred that the materials in the projections at regions 140, 148 be harder than the material at the rail sides 122, 123, so that during a braking operation, surfaces or regions 140, 148 actually dig into the rail sides 122, 123, respectively.

In general, the rail side engaging safety catch arrangement 120 provides for a preferred operation with respect to the issues characterized above for the prior art safety catch assembly characterized. For example when implemented in the preferred embodiment shown:

1. The arrangement 120 is not as sensitive to lateral movement of the door panel 12 characterized above at arrow 118, FIG. 4, as long as the location of the brake members 131, 132 is provided at an adequate depth inwardly from edge 32, FIG. 4. In general, a depth inwardly from edge 32, indicated at dimension D1, FIG. 5, on the order of at least about 0.25 inch, will be more than adequate to accommodate side to side shifting of a typical door panel 12, over extended use.
2. Secondly, it is relatively easy, during assembly of the arrangement, to ensure that the brake members 131, 132 are properly oriented relative to rail 31, since the dimensions are primarily controlled by the manufacturer with respect to the spacing apart of brake members 131, 132 on base 35 and with specific centering on rail 31 being managed by the pairs 40 of rollers.
3. Forces applied to the rail 31 are directed against sides 122, 123 and are oppositely directed during braking, to reduce outward bowing of the rail 31 and to reduce bowing stress applied against the doorframe.

B. The Preferred Actuator Assembly and Biasing Mechanism for the Rail Side Engaging Safety Catch Arrangement 120.

In the previous section, operation of the brake members 131, 132 to provide for side braking engagement with rail 31, during catastrophic failure of the lift mechanism 8, was described. Specifically, engagement between the brake members 131, 132 and the rail 31 was shown, and advantages were referenced. A preferred embodiment, in which the brake members 131, 132 are mounted in a rotable manner, to accomplish movement between the free and brake positions, was shown. In this section, description is provided relating to portions of the rail side engaging safety catch mechanism 120 that concern appropriate actuation during a catastrophic failure of the lift mechanism 8; and, biasing of the brake members 131, 132 into the braking or locking position indicated in FIGS. 5 and 8, upon actuation.

Herein, portions of the safety catch assembly 70, including portions of the side engaging safety catch mechanism 120, which cause the movement of the brake members 131, 132 into the locking or braking position, will be referenced as the biasing mechanism 160 for the brake members 131, 132, FIG. 6. Herein, portions of the safety catch mechanism 70, including portions of the side engaging safety catch mechanism 120, which provide for a release of the biasing mechanism, to cause the braking, are referred to herein as the actuator assembly 161, FIG. 4. The preferred actuator assembly 161 will generally be characterized as including: a stay mechanism 162 which holds the brake members in a set, free or non-locking (unlocked) position until catastrophic failure of the lift mechanism; and, a release mechanism 163, FIG. 5, which operates to release the first and second brake members 131, 132 for braking movement, under biasing of the biasing mechanism 160.

As indicated above, for the preferred embodiment the brake members 131, 132 are rotatable, between the free and braking positions.

In general, for the particular preferred assembly 1 depicted in the drawings, the actuator assembly 161, stay mechanism 162, release mechanism 163 and biasing mechanism 160 will be understood by referring to FIGS. 4–8.

Referring to FIG. 6, a schematic cross-sectional view is provided taken generally along line 6—6, FIG. 4. The reference number 170, FIG. 6, generally indicates the mounting mechanism for the first brake member 131, and reference number 171 generally indicates the mounting mechanism for the second brake member 132.

Referring to FIG. 6, mounting mechanism 170 preferably includes axle shaft 174 rotatably mounted in tube or sheath 175, for rotation about axis 135. Tube 175 thus operates as a bearing for shaft 174. Rotatable brake member 131 is mounted on axle 174, for example by welding, so that as the axle 174 rotates in tube 175, about axis 135, so does rotatable brake member 131.

A similar construction is provided for the preferred mounting mechanism 171, comprising shaft or axle 178 mounted in tube or sheath 179 for rotation about axis 144, with rotatable brake member 132 secured to the axle 178, and with tube 179 operating as a bearing. The tubes 175, 179 are mounted on base 35.

The mounting mechanisms 170, 171, then provide for mounting and appropriate positioning of brake members 131, 132, projecting outwardly from side 182 of base 35, to define channel 184 and to properly support members 131, 132 for side engagement with rail member 31, as shown in FIG. 8.

In general, the biasing mechanism 160 operates to cause movement of brake members 131, 132 from the unlocked or non-braking orientation indicated in FIGS. 4, 6 and 7, to the braking or locked orientation indicated in FIGS. 5 and 8, when released for rotational movement by the actuator mechanism or assembly 161. (For the preferred embodiment shown, the movement of the brake members 131, 132 is rotational). The actuator assembly 161 preferably includes stay mechanism 162, which retains the rotatable brake members 131, 132 in the free, non-braking or non-locking, orientations indicated in FIGS. 4, 6 and 7, until a defined catastrophic failure of the lift mechanism 8 occurs; and, the actuator assembly 161 includes release mechanism 163, which operates, during a defined or selected catastrophic failure of the lift mechanism 8, to permit biasing mechanism 160 to bias the brake members 131, 132, into the braking or locked positions indicated in FIGS. 5 and 8.

The biasing mechanism 160 will be understood by reference to FIGS. 4, 5, 6 and 7.

Referring to FIG. 6, the preferred biasing mechanism 160 generally comprises a biasing assembly 192 for brake member 131, and biasing assembly 193 for brake member 132.

In general, the preferred biasing assembly 192 comprises torsion spring 195 (or other biasing construction capable of applying torsional force), lock pin 196, cam or member 197 and lock pin 198. More specifically, and referring to FIG. 5, cam 197 is secured to end 200 of axle 174, on a portion of the axle 174 on an opposite side of base 35 from end 201 on which brake member 131 is mounted. Similarly to brake member 131, cam 197 is secured to axle 174, for example by welding. Thus, as the axle 174 rotates in tube 175, cam 197 rotates, as does brake member 131.

The torsional biasing arrangement, in this instance torsion spring 195, is mounted to circumscribe axle 174 in a region between base 35 and cam 197. The preferred torsion spring 195 has ends 203 and 204. When the ends 203 and 204 are pinched rotatably toward one another, (from a relaxed position of the torsion spring 195) the torsion spring 195 is characterized herein as being "under rotatable compression" or "under compression."

End 203 torsion spring 195 is preferably positioned against lock pin 196 on base 35; and, end 204 of torsion spring 195 is preferably secured against lock pin 198 on cam 197. The pins 196, 198 are rotatably positioned relative to one another, to secure, rotatably, torsion spring 195, under torsional or rotational pressure, therebetween, when the axle 174 is rotated into the position shown in FIGS. 4, 6 and 7, i.e. into the non-locking or free orientation. Because pin 196 is fixed in position on base 35, and because pin 198 is secured to cam 197, when a mechanism retaining torsion spring 195 in the compressed or wound position of FIGS. 4, 6 and 7 is released, the torsion spring 195 will cause the cam 197, as torsional force on spring 197 is relieved, to pivot in the general direction indicated at arrow 136, FIG. 7. This will cause rotation of the axle 174 in tube 175, and thus also movement of brake member 131 in the general direction of arrow 136, FIG. 7. (As an alternative to a spring 197, an appropriate elastomer member could be used.)

Referring to FIG. 6, preferred biasing assembly 193 analogously comprises a torsional biasing mechanism, for example, torsion spring 230, lock pin 231 on base 35, pivotable cam or member 232 on axle 178, and lock pin 234 on cam 232. Torsion spring 230 is secured, under rotational compression, between pins 231 and 234, when in the orientation of FIGS. 4, 6 and 7, so that, should the compression be released, movement of cam 232 in the direction of arrow 145, FIG. 7 will cause an analogous rotation of axle 178 in tube 179, and thus also rotation of brake member 132 in the direction of arrow 145, FIG. 7, into a locking orientation, FIG. 8.

In sum, the preferred biasing assembly or mechanism 160 generally comprises biasing assemblies 192, 193 associated with each of brake members 131, 132 respectively. The particular biasing assemblies 192, 193, for the preferred embodiment depicted, comprise individual torsion of biasing members or springs 195, 230, positioned to cause selective movement of the brake members 131, 132, as compression or torsion forces of the springs 195, 230, are selectively released.

In general, the preferred actuator mechanism 161 operates as follows: the stay mechanism 162 retains the cam members 197, 232, in a set position with the torsion springs 195, 230 under torsional compression in the non-locking orientations depicted in FIGS. 4, 6 and 7 during normal operation of the door assembly 1. The release mechanism 163 of the actuator assembly 161 operates to release the cams 197, 232, for movement under biasing by the torsion springs 195, 230, respectively, into the braking orientation shown in FIGS. 5 and 8, when a defined catastrophic failure of the lift mechanism occurs. Operation of the preferred actuator assembly 161 (and thus the stay mechanism 162 and release mechanism 163) is generally as follows.

Referring to FIG. 6, the preferred stay mechanism 163 comprises a stay assembly 250 for cam 197; and, stay assembly 251 for cam 232. Stay assembly 250 comprises a lock pin 260 on side 261 of cam 197, i.e. a side opposite from lock pin 198. Pin 260 is oriented so that it engages a side 263 of actuator arm 80, with torsion spring 195 under compression in the "set" position, i.e., when the assembly 1 is in a normal operating condition, FIGS. 4 and 6.

Lock pin 260 is preferably sized such that when actuator or control arm 80 pivots about axle 87 in the direction of arrow 99, FIG. 4, the arm 80 moves out of engagement with lock pin 260, permitting movement of cam 197, from the free or set position (FIG. 7) to the locked position (FIG. 8).

In a similar fashion, the preferred stay assembly 251 (FIG. 6) comprises lock pin 270 on side 271 of cam 232, positioned to engage side 272 of actuator arm 80, when torsion spring 230 is in the free or set position; and, lock pin 270 is sized such that when control arm 80 is moved about axle 87 to the failure position, FIG. 5, lock pin 270 is released from engagement with side 272, to allow cam 232 to move in the direction of arrow 145, FIG. 7, as torsion forces are released from spring 230, driving brake member 132 into the braking or locked position indicated in FIG. 8.

From the above, the release mechanism 163 for the particular actuator assembly 161 depicted, will be understood to comprise: control or actuator arm 80, axle 87, bracket 90 and spring 110 of safety catch assembly 70 as previously characterized. Thus, the particular side engaging safety catch mechanism 120 depicted can be added onto a previously existing door assembly, using a previously existing safety catch assembly of the type characterized above as being in the prior art. It is also noted that side engaging safety catch mechanism 120 can be used with a non-prior art safety catch assembly that does not have at end 95, of control arm 80, a brake region 90 to engage an edge of a guide rail, during a defined catastrophic failure of a lift mechanism 8.

The following suggestions will be useful in preparing working examples of the invention according to the figures. In general, the biasing arrangement preferably comprising spring 110 should be selected to be strong enough to pull against a broken or loose cable adequately, to be able to move arm 80 to the braking position. Generally, it must also have enough force to overcome any corrosion or contamination at the pivot point for arm 80. It is found that an arrangement having a spring rate of five (5) pounds per inch and providing about fifteen (15) pounds of pulling force at the point where cable 84 is attached to the arm 80, is sufficient for a typical applications. It will be a variable, however, selectable from application to application depending in part upon the materials used to form the assembly.

Referring to FIG. 6, the torsional biasing mechanisms, depicted as preferably comprising torsion springs 195 and 230 should generally be strong enough to overcome corrosion and contamination over time. With a typical door panel that weighs up to about 1,000 pounds, torsion springs that provide about five (5) foot pounds of torque when the brake is in the set position, and about four (4) foot pounds of torque when in the brake position, are adequate. As the weight of the door panels increase, it will typically be desirable to increase the amount of torque provided to the two positions. Again, a variable to be considered in manufacturing and assembly, is the specific materials and weight of materials utilized for the parts that need to be moved by the springs.

It is noted that as an alternative to the assembly depicted in FIGS. 4 and 5, the safety catch assembly can be partially preinstalled on a plate, which would then be secured to plate 34. This may facilitate manufacturing, assembly and installation, when the manufacture of the safety catch assembly is not conducted by the installer of that assembly on a door panel.

Also in general, it will be convenient and preferred when the safety catch assembly has the configuration of FIGS. 4 and 5, to mount the safety catch assembly such that brake members 131, 132 are mounted generally in alignment with the rollers 41, 42, FIG. 3 so that the same spacing inwardly from edge 32 is used, and so that the same distance of spacing from the rail sides 122, 123 is used.

It is also noted that when the safety catch assembly has the configuration of FIGS. 4, 5 and 6, it is preferred to position side cams 197, 232, FIG. 6, so that in the center of non-brake position, the spacing 301 therebetween is not more than ⅛ inch and typically on the order of 1/16 inch or less. An advantage from this is that should, during a braking operation, the force applied by members 131, 132 tend to bow the ends of the pins 174, 178, (on which the brake members 131 and 132 are respectively mounted), away from one another, the bowing or bending will be limited by the cams 197, 232, engaging one another at gap 301.

IV. Safety Catch Arrangements for Upper Panel 10

Herein, panel 10 will generally be referred to as an "upper panel". The term "upper panel" in this context means a panel above the lower most panel 12, when the door panel arrangement 7 is in its lowest position. In general, for an upper panel 10, there is no lift cable that has an end secured directly to a mechanism mounted on the panel. Rather, the cables are generally secured to the building frame above the doorway, with the cable extending through an appropriate bracket, brace or pulley secured to the panel 10. Such pulleys are shown in FIG. 1, at 300.

In many instances, a safety catch arrangement is not mounted on an upper panel 10. Rather, for such arrangements, the tracks associated with an upper panel simply terminate at the bottom most point of normal. travel for the panel 10, with a fixed jam or block positioned on those tracks to stop further downward movement of the panel 10.

The safety catch assembly according to the present invention can be utilized in association with an upper panel 10. In general, all that would be required would be modifying the safety catch assembly 70, FIG. 4, to accommodate the fact that it is not attached to the end of a cable, but rather has, at an upper end 81 of control arm 80, a pulley or other bracket, similar to pulley 300, FIG. 1. Braking operation would be the same as for safety catch assembly 70 except instead of being pulled through a hole in an upper portion of the control arm, the cable would be pulled through a bracket or pulley, as the arm is moved.

V. The Alternate Embodiment of FIGS. 9 And 10

An advantage to arrangements generally as characterized above in connection with FIGS. 3–8, is that they can be readily adapted for use with door panel arrangements mounted in alternate manners. An example of this will be understood by reference to FIGS. 9 and 10.

Referring to FIG. 9, vertical lift door assembly 400 is depicted. The assembly may be generally as characterized above in connection with FIGS. 1–8, except as now described. In general, the vertical lift door assembly 400 comprises door frame track assembly 406 on which is mounted a door panel arrangement 407. A lift mechanism, not shown, would be used, typically in manner analogous to door lift mechanism 8, FIGS. 1 and 2.

In FIG. 9, a portion of the assembly 400 is depicted analogous to the view of FIG. 3 discussed above. Principal differences will be characterized herein.

In particular, for the embodiment of FIG. 9, the door frame track assembly 406 comprises side rail 410. In the embodiment shown, side rail 410 comprises first and second pieces 411, 412, mounted spaced apart with the door panel arrangement 7 riding up and down on a mounting arrangement positioned between them. In particular, sides 410 and 411 comprise angles 413 and 414 mounted with side track surfaces 420 and 421 oriented opposite to one another, and opposed to one another. (Alternately, surfaces 420 and 421 could be inside surfaces of a single piece comprising a 3-walled, single piece, trough, with analogous results.)

Still referring to FIG. 9, the corresponding door panel arrangement 407 comprises first and second opposite panels 430 and 431 having end member 432 therebetween. End member 432 has base 433 and sides 434 and 435.

Unlike the arrangement of FIG. 1, a single roller 440 is used, mounted on axle 441 and extending outwardly from base 433 toward wall 450. In general, wheel 440 is rotatably mounted on axle 441, in shaft or bearing 451, secured in place by bolt 452.

Operation of the arrangement depicted in FIG. 9, should be apparent. In general, wheel 440 is positioned between surfaces 420 and 421. Spacing gaps 460 may be similar to spacing gaps 44, FIG. 3.

As with the arrangement described in connection with FIG. 3, in general, a wheel 440 would be associated with each comer of a door panel, and if the panel were a spliced panel, a wheel 440 would typically be associated with the splice as well.

The type of mounting arrangement depicted in FIG. 9 is common for some vertical lift doors. The safety catch assembly depicted in FIGS. 3–8, can be readily adapted for use for arrangement of FIG. 9. This will be apparent by review of FIG. 10.

Figure 10:
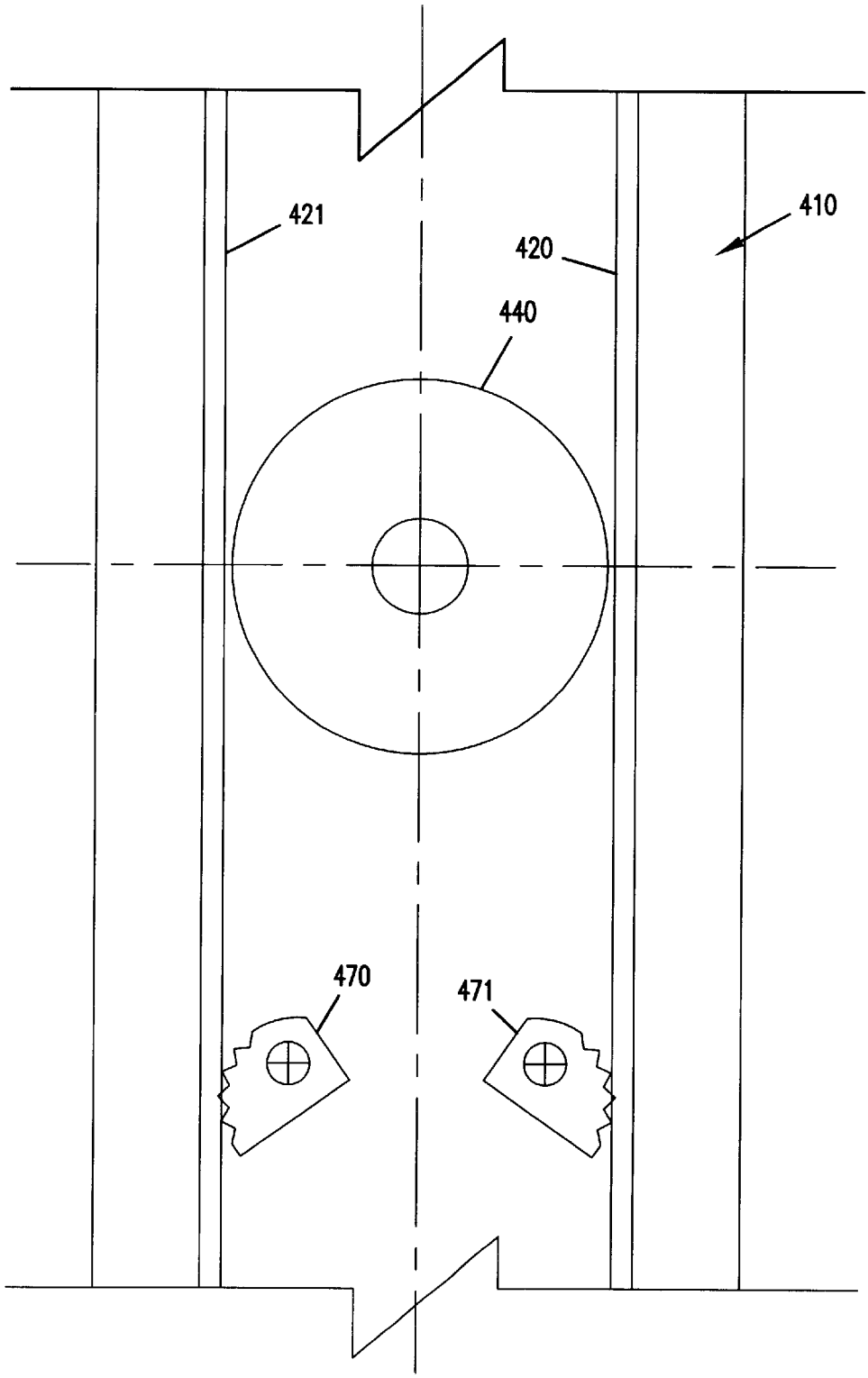
FIG. 10 is a view analogous to FIG. 8, but depicting a second embodiment in a braking orientation.

In FIG. 10, a schematic depiction is presented analogous to FIG. 8. In FIG. 10, wheel 440 is shown positioned between opposite or opposed side surfaces 420 and 421 of the rail track 410. Referring to FIG. 10, brake members 470 and 471 are depicted. The brake members 470 and 471 would be mounted on a remainder of a safety catch assembly, out of view, generally analogous to that depicted in FIGS. 4–7, except modified so that the brake members 470 and 471 rotate outwardly to engage surfaces 420 and 421. That is, the braking forces applied by brake members 470 and 471 are still opposite from one another, as are the braking forces of the arrangement depicted in FIGS. 4–8, but unlike the arrangement of FIGS. 4–8, the forces applied by brake members 470 and 471 are in directions approximately 180° opposite from one another. Of course, the brake members 470, 471 are mounted on opposite sides from one another, relative to FIG. 8.

Rotation in opposite manners to FIG. 8 can be accommodated by an opposite mounting of the torsion springs, and with movement of the pins that allow or prevent rotation. Appropriate adjustments are apparent by reviewing FIGS. 4, 5, 6, and 7.

In general, and as an example, the lock pins and springs can be oriented so that rotation upon release is in an opposite direction; and, the lock pins, such as pin 260, FIG. 4, can be oriented to prevent rotation in an opposite direction, during locking. A simple adjustment in the pins, referring to FIG. 4, would be to position lock pin 260 above line 6—6, as opposed as to below it.

Of course, alternate mechanical adjustments in FIGS. 3–8 can be created, to obtain the same result. For example, referring to FIG. 10, members 470 and 471 could have been mounted so that braking rotation would be over the top, as opposed to up from underneath.

Herein, in general, the modification of FIGS. 9 and 10 can be characterized in the same general terms as the arrangement of FIGS. 3–7. Each has first and second brake members positioned to, respectively, engage two side portions of a side rail, when installed and when in the braking orientation. The braking forces are directed in opposite directions. (However, for the arrangement of FIGS. 3–7, the braking forces are oriented to be toward one another, whereas for the arrangement of FIGS. 9 and 10, the braking forces are oriented to be directed oppositely from one another.)

It is noted that with the arrangement of FIGS. 9 and 10, in general, the actuator arm would likely not have the rail side engaging arrangement at a bottom end, since the edge brake has no edge directed toward the arm. Thus, if the control arm of FIGS. 4 and 5 are used, in general the braking arrangement in the region indicated at 95, 96 and 97, FIG. 4, would be absent (or would be nonfunctional).

What is claimed is:

1. A safety catch assembly for selectively inhibiting downward movement of a panel that travels vertically in a track having a side rail, during catastrophic failure of a panel lift mechanism; said safety catch assembly comprising:

(a) first and second brake members selectively actuatable to move from free positions to braking positions;

(i) said first brake member being rotatably mounted on a first end of a first rotatably mounted axle, for rotational movement between said free and braking positions;

(ii) said second brake member being rotatably mounted on a first end of a second rotatably mounted axle, for rotational movement between said free and braking positions;

(iii) each one of said first and second opposed, brake members being moved out of braking engagement with the side rail, when installed and when said brake members are in said free positions; and (iv) each one of said first and second opposed, brake members being moved into braking engagement with the side rail, when installed and when said brake members are in said braking positions, (A) said first brake member being oriented to apply a first braking pressure to a first side portion of the side rail, when in said braking position; and, (B) said second brake member being oriented to apply a second braking pressure to a second side portion of the side rail, when in said braking position, said second braking pressure being applied in a direction generally opposite to said first braking pressure;

(b) an actuator assembly including a stay mechanism and a release mechanism;

(i) the stay mechanism being constructed and arranged to maintain said first and second brake members in said free positions, when installed, until a selected, catastrophic, failure of the lift mechanism; and (ii) the release mechanism being constructed and arranged to release said first and second brake members for movement into said braking positions, when installed, upon a selected, catastrophic, failure of the lift mechanism; and, (c) a biasing mechanism constructed and arranged to move the first and second brake members into said braking positions, when installed and when said release mechanism releases said brake members for movement, said biasing mechanism comprising:

(i) a first torsion spring mounted on, and circumscribing, said first rotatably mounted axle; and (ii) a second torsion spring mounted on, and circumscribing, said second rotatably mounted axle.

2. A safety catch assembly according to claim 1 wherein:

(a) the first and second brake members each comprise a non-circular member having a brake surface with projections.

3. A safety catch assembly according to claim 1 wherein:

(a) the first and second brake members are oriented to apply braking pressure directed toward one another.

4. A safety catch assembly according to claim 1 wherein:

(a) the first and second brake members are oriented to apply braking pressure directed away from one another.

5. A safety catch assembly for selectively inhibiting downward movement of a panel that travels vertically in a track having a side rail, during catastrophic failure of a panel lift mechanism; said safety catch assembly comprising:

(a) first and second brake members selectively actuatable to move from free positions to braking positions;

(i) said first brake member being rotatably mounted on a first end of a first rotatably mounted axle, for rotational movement between said free and braking positions;

(ii) said second brake member being rotatably mounted on a first end of a second rotatably mounted axle, for rotational movement between said free and braking positions;

(iii) each one of said first and second opposed, brake members being moved out of braking engagement with the side rail, when installed and when said brake members are in said free positions; and (iv) each one of said first and second opposed, brake members being moved into braking engagement with the side rail, when installed and when said brake members are in said braking positions, (A) said first brake member being oriented to apply a first braking pressure to a first side portion of the side rail, when in said braking position; and, (B) said second brake member being oriented to apply a second braking pressure to a second side portion of the side rail, when in said braking position, said second braking pressure being applied in a direction generally opposite to said first braking pressure;

(b) an actuator assembly including a control arm, first and second rotatable cams, a stay mechanism and a release mechanism;

(i) said first rotatable cam being positioned on a second end of said first rotatably mounted axle;

(ii) said second rotatable cam being positioned on a second end of said second rotatably mounted axle; and (iii) said control arm being mounted for movement between a first free position and a second, failure, position;

(A) said control arm, when in said first free position, being positioned to inhibit rotation of each of said first and second rotatable cams; and (B) said control arm, when in said second, failure, position, being positioned to permit rotation of said first and second rotatable cams;

(iv) said stay mechanism being constructed and arranged to maintain said first and second brake members in said free positions, when installed, until a selected, catastrophic, failure of the lift mechanism; and (v) said release mechanism being constructed and arranged to release said first and second brake members for movement into said braking positions, when installed, upon a selected, catastrophic, failure of the lift mechanism; and, (c) a biasing mechanism constructed and arranged to move the first and second brake members into said braking positions, when installed and when said release mechanism releases said brake members for movement.

6. A safety catch assembly according to claim 5 wherein:

(a) said control arm is pivotally mounted for selected rotation about an axis, when moved between said first, free, position and said second, failure, position.

7. A safety catch assembly according to claim 6 wherein:

(a) said actuator mechanism includes a biasing member under extension to selectively bias said control arm from said first, free, position to said second, failure, position.

8. A safety catch assembly according to claim 7 wherein:

(a) said biasing member comprises a spring.

9. A safety catch assembly according to claim 7 wherein:

(a) said first rotatable cam includes a first lock pin thereon; and, (b) said second rotatable cam includes a second lock pin thereon;

(i) said first and second lock pins being positioned on said first and second cams, respectively, to:

(A) engage said control arm and inhibit rotation of said first and second cams, when said control arm is in said first, free, position; and, (B) to disengage from said control arm and permit rotation of said first and second cams, when the control arm is in said second, failure, position.

10. A safety catch assembly according to claim 9 wherein:

(a) said control arm includes an edge brake portion oriented to engage an edge of the side rail, when installed and when in said second, failure, position.

11. A safety catch assembly according to claim 5 wherein:

(a) the first and second brake members each comprise a non-circular member having a brake surface with projections.

12. A safety catch assembly according to claim 5 wherein:

(a) the first and second brake members are oriented to apply braking pressure directed toward one another.

13. A safety catch assembly according to claim 5 wherein:

(a) the first and second brake members are oriented to apply braking pressure directed away from one another.

14. A door assembly comprising:

(a) a side rail;

(b) a door panel mounted on said side rail;

(c) a lift mechanism including a lift cable; and, (d) a safety catch assembly for selectively inhibiting downward movement of said door panel, relative to said side rail, after a defined failure of said lift mechanism; said safety catch assembly comprising:

(i) first and second brake members, said side rail being positioned to extend between said first and second brake members, said brake member being selectively actuatable to move from free positions to braking positions;

(A) each one of said first and second brake members being moved out of braking engagement with said side rail, when said brake members are in said free positions; and (B) each one of said first and second brake members being moved into braking engagement with said side rail, when said brake members are in said braking positions, (1) said first brake member being oriented to apply a first braking pressure to a first side portion of said side rail, when in said braking position; and, (2) said second brake member being oriented to apply a second braking pressure to a second side portion of said side rail, when in said braking position, said second braking pressure being applied in a direction generally toward said first braking pressure;

(ii) an actuator assembly including a stay mechanism and a release mechanism;

(A) said stay mechanism being constructed and arranged to maintain said first and second brake members in said free positions, until a selected, catastrophic, failure of said lift mechanism; and (B) said release mechanism being constructed and arranged to release said first and second brake members for movement into said braking positions, upon a selected, catastrophic, failure of said lift mechanism; and, (iii) a biasing mechanism constructed and arranged to move said first and second brake members into said braking positions when said release mechanism is actuated to release said brake members for movement.

15. A door assembly according to claim 14 wherein:

(a) said first brake member is a rotatable brake member mounted on a first end of a first rotatably mounted axle; and, (b) said second brake member is a rotatable brake member mounted on a first end of a second rotatably mounted axle.

16. A door assembly according to claim 15 wherein:

(a) said actuator mechanism includes: a control arm; and, first and second rotatable cams;

(i) said first rotatable cam being positioned on a second end of said first rotatably mounted axle;

(ii) said second rotatable cam being positioned on a second end of said second rotatably mounted axle; and (iii) said control arm being mounted for movement between a first, free, position and a second, failure, position;

(A) said control arm, when in said first, free, position, being positioned to inhibit rotation of each of said first and second rotatable cams; and (B) said control arm, when in said second, failure, position, being positioned to permit rotation of said first and second rotatable cams.

17. A door assembly according to claim 16 wherein:

(a) said control arm includes an edge brake portion oriented to engage an edge of said side rail, when installed and when in the second, failure, position.

18. A door assembly comprising:

(a) a side rail;

(b) a door panel mounted on said side rail;

(c) a lift mechanism including a lift cable; and, (d) a safety catch assembly for selectively inhibiting downward movement of said door panel, relative to said side rail, after a defined failure of said lift mechanism; said safety catch assembly comprising:

(i) first and second brake members selectively actuatable to move from free positions to braking positions;

(A) said first brake member being a rotatable brake member mounted on a first end of a first rotatably mounted axle;

(B) said second brake member being a rotatable brake member mounted on a first end of a second rotably mounted axle;

(C) each one of said first and second brake members being moved out of braking engagement with said side rail, when said brake members are in said free positions; and (D) each one of said first and second brake members being moved into braking engagement with said side rail, when said brake members are in said braking positions, (1) said first brake member being oriented to apply a first braking pressure to a first side portion of said side rail, when in said braking position; and, (2) said second brake member being oriented to apply a second braking pressure to a second side portion of said side rail, when in said braking position, said second braking pressure being applied in a direction generally opposite to said first braking pressure;

(ii) an actuator assembly including a control arm, first and second rotatable cams, a stay mechanism and a release mechanism;

(A) said first rotatable cam being positioned on a second end of said first rotatably mounted axle;

(B) said second rotatable cam being positioned on a second end of said second rotatably mounted axle; and (C) said control arm being mounted for movement between a first, free, position and a second, failure, position;

(1) said control arm, when in said first, free, position, being positioned to inhibit rotation of each of said first and second rotatable cams; and (2) said control arm, when in said second, failure, position, being positioned to permit rotation of said first and second rotatable cams;

(D) said stay mechanism being constructed and arranged to maintain said first and second brake members in said free positions, until a selected, catastrophic, failure of said lift mechanism; and (E) said release mechanism being constructed and arranged to release said first and second brake members for movement into said braking positions, upon a selected, catastrophic, failure of said lift mechanism; and, (iii) a biasing mechanism constructed and arranged to move said first and second brake members into said braking positions when said release mechanism is actuated to release said brake members for movement.

19. A door assembly according to claim 18 wherein:

(a) said side rail comprises two side regions with surfaces facing one another; and (b) said first and second brake members are positioned between the two side regions to direct braking forces away from one another.

20. A door assembly according to claim 18 wherein:

(a) said side rail is positioned to extend between said first and second brake members; and (b) said first and second brake members are oriented to direct braking forces toward one another.

21. A door assembly according to claim 18 wherein:

(a) said control arm includes an edge brake portion oriented to engage an edge of said side rail, when installed and when in the second, failure, position.

22. A safety catch assembly for selectively inhibiting downward movement of a panel that travels vertically in a track having a side rail, during catastrophic failure of a panel lift mechanism; said safety catch assembly comprising:

(a) first and second brake members selectively actuatable to move from free positions to braking positions;

(i) said first brake member being rotatably mounted on a first end of a first rotatably mounted axle, for rotational movement between said free and braking positions;

(ii) said second brake member being rotatably mounted on a first end of a second rotatably mounted axle, for rotational movement between said free and braking positions;

(iii) each one of said first and second opposed, brake members being moved out of braking engagement with the side rail, when installed and when said brake members are in said free positions; and (iv) each one of said first and second opposed, brake members being moved into braking engagement with the side rail, when installed and when said brake members are in said braking positions, (A) said first brake member being oriented to apply a first braking pressure to a first side portion of the side rail, when in said braking position; and, (B) said second brake member being oriented to apply a second braking pressure to a second side portion of the side rail, when in said braking position, said second braking pressure being applied in a direction generally opposite to said first braking pressure; and (b) a biasing mechanism constructed and arranged to move the first and second brake members into said braking positions, when installed and when said release mechanism releases said brake members for movement, said biasing mechanism comprising:

(i) a first torsion spring mounted on, and circumscribing, said first rotatably mounted axle; and (ii) a second torsion spring mounted on, and circumscribing, said second rotatably mounted axle.

23. A safety catch assembly according to claim 22 wherein:

(a) the first and second brake members are oriented to apply braking pressure directed toward one another.

24. A safety catch assembly according to claim 22 wherein:

(a) the first and second brake members are oriented to apply braking pressure directed away from one another.

* * * * *